United States Patent [19]

Knispel et al.

[11] Patent Number: 4,643,345

[45] Date of Patent: Feb. 17, 1987

[54] COMBINATION STAPLE AND RIVETING GUN

[75] Inventors: Barry Knispel, Hillsdale; Rudolf Wingert, West Milford, both of N.J.

[73] Assignee: Arrow Fastener Company, Inc., Saddle Brook, N.J.

[21] Appl. No.: 725,122

[22] Filed: Apr. 19, 1985

Related U.S. Application Data

[63] Continuation-in-part of Ser. No. 632,628, Jul. 19, 1984, abandoned.

[51] Int. Cl.[4] ..... B21J 15/38; B25C 5/00

[52] U.S. Cl. ..... 227/156; 72/391; 227/119; 227/140; 227/146

[58] Field of Search ..... 72/391, 481; 227/55, 227/119, 138, 2, 140, 146, 156

[56] References Cited

U.S. PATENT DOCUMENTS

| | | | |
|---|---|---|---|
| 2,668,290 | 2/1954 | Heller | 227/132 |
| 2,775,763 | 1/1957 | Flammer | 227/132 X |
| 3,429,013 | 2/1969 | Pabich et al. | 227/156 |
| 3,724,738 | 4/1973 | Hurst | 227/55 X |
| 4,089,099 | 5/1978 | Nivet | 72/391 X |
| 4,537,343 | 8/1985 | Johansson | 227/156 X |

FOREIGN PATENT DOCUMENTS

| | | | |
|---|---|---|---|
| 2658336 | 7/1977 | Fed. Rep. of Germany | 72/391 |

*Primary Examiner*—Robert L. Spruill
*Assistant Examiner*—Taylor J. Ross
*Attorney, Agent, or Firm*—Pasquale A. Razzano

[57] ABSTRACT

A staple gun tacker having a staple driving blade is disclosed which is adapted to be used in driving and setting a rivet of the type having a pin member mounted in a rivet shank having an expandable workpiece piercing free end. The staple gun tacker includes a front cover over the driving mechanism which has a recess or slot formed therein to receive the pin member or top of the rivet and guide it into alignment with the drive blade of the staple gun so that upon operation of the staple gun the driving blade applies a driving force to drive the pin member of the rivet and thus expands the free end of the rivet.

4 Claims, 5 Drawing Figures

COMBINATION STAPLE AND RIVETING GUN

This application is a continuation-in-part of U.S. patent application Ser. No. 632,628 filed July 19, 1984, now abandoned.

BACKGROUND OF THE INVENTION

The present invention relates to staple gun tackers and more particularly to a staple gun tacker constructed to permit it to be also used to drive rivets.

Various types of rivet driving tools have been previously proposed for use by the homeowner or "do it yourselfer". These devices generally consist of special purpose hand tools associated with specially designed rivets to enable the homeowner to rivet pieces of sheet metal or other workpieces together in a simple and relatively inexpensive manner. However, in each instance a separate special tool is required.

To overcome the need for a separate special riveting tool, certain devices have been previously proposed such as, for example, is disclosed in German Gebrauchsmuster No. 8223170.2, filed Aug. 17, 1982. In the device disclosed in that German Gebrauchsmuster, an attachment is adapted to be fitted on the working end of a staple gun tacker so that the blade of the tacker drives a pin into a hollow rivet. The pin is slidably mounted in the attachment and its movement into the bore of the rivet causes the rivet to flare or expand in a hole in the workpiece, thereby securing the rivet to the workpiece. With the device disclosed in that Gebrauchsmuster however, there are a number of problems in that the driving pin can easily be removed or fall from the attachment and be lost. In addition, the driving pin of the attachment enters the rivet and can become jammed. Moreover, it is relatively difficult to align the driving pin with the rivet prior to operation of the staple gun tacker. Also rivet has no positive metal interference on bottom and attached parts can easily be pulled apart.

Another system for installing rivets is disclosed in U.S. Pat. No. 3,724,738. In that case a specially designed rivet is provided in which a driving pin is mounted in the rivet itself and a driving member is, somehow, impacted against the driving pin to force the rivet to expand. However, the patent does not disclose how the driving force is applied.

It is an object of the present invention to provide a relatively simple modification to a conventional hand-operated electric, or pneumatic or other type staple gun tacker which will enable the staple gun tacker to drive rivets in a workpiece.

Another object of the present invention is to provide a staple gun tacker which will also drive rivets.

A further object of the present invention is to provide a reliable and easily operated staple gun tacker which readily guides and drives rivets.

The above, and other objects, features and advantages of the present invention will be apparent from the following detailed description of an illustrative embodiment thereof, when read in connection with the accompanying drawings, wherein:

DETAILED DESCRIPTION

Figure 1:
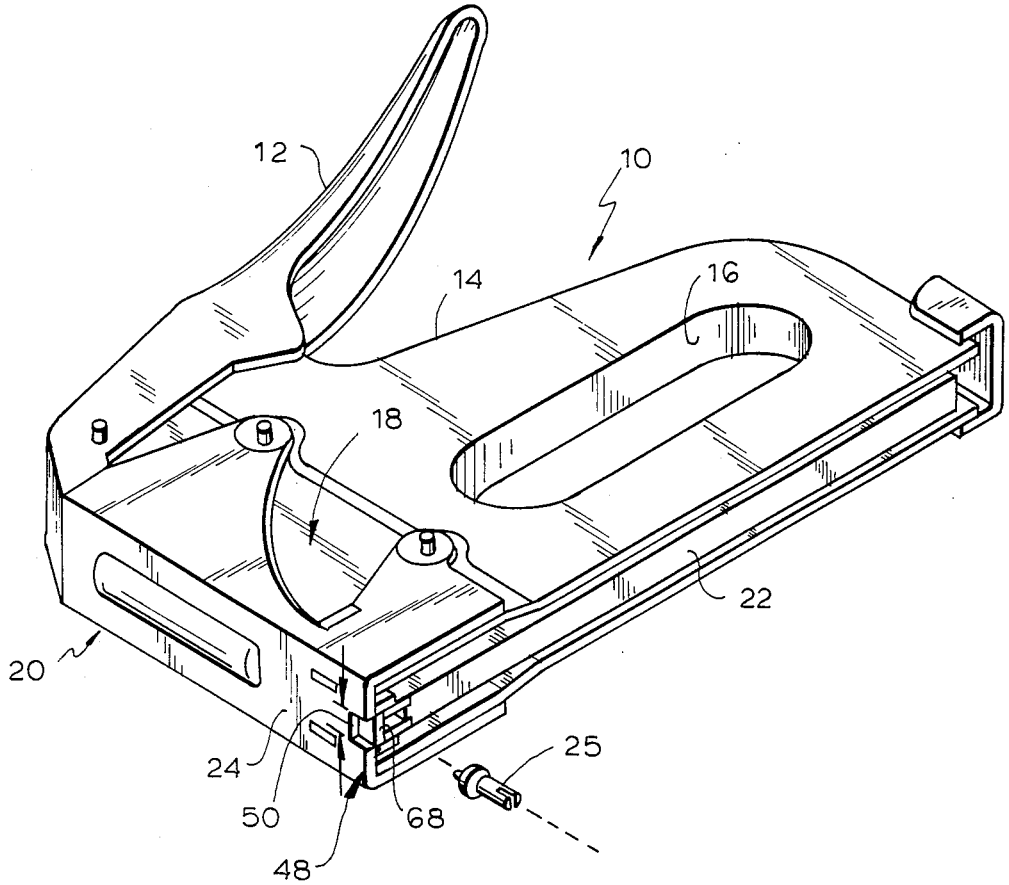
FIG. 1 is a perspective view of a staple gun tacker modified in accordance with the present invention to permit it to drive rivets in workpieces.

Referring now to the drawing in detail, and initially to FIG. 1 thereof, a staple gun tacker 10 according to the present invention is illustrated. Staple gun tacker 10 is basically of known construction and its conventional form is available from the Arrow Fastener Company, Inc. of Saddle Brook, N.J. under the trademark "T-50". The Arrow T-50 staple gun tacker has been on the market to the public for over thirty years and is of a known construction. It is a general purpose heavy-duty stapling tool, used in millions of homes throughout the country for various "do it yourself" application, such as installation of insulation. The outside overall appearance of the T-50 staple gun tacker is so well known that the United States International Trade Commission has declared it to be a trademark.

Staple gun tacker 10 includes an operating handle 12 pivotally mounted in a main housing 14. The latter includes a finger opening 16 and a drive mechanism 18 contained within the working end 20 at the forward portion of the tacker. In use as a staple gun tacker, the base portion 22 of the staple gun contains a magazine of staples, adhered together in a known manner, as a cartridge. By inserting the fingers of the hand in the opening 16 while pressing the handle 12 with the palm, the user of the staple gun tacker operates the drive mechanism 18 to move its drive blade 68 in the forward end of the device and cause it to drive a staple in a known manner.

The staple gun tacker 10 includes a front cover 24 which, in accordance with the present invention, is modified from the conventional construction to permit the staple gun tacker to be used for installing rivets. The only modification from the normal operation of the staple gun tacker is that no staples are present in the magazine (or the magazine is removed) when the device is operated for the purpose of installing rivets.

The staple gun tacker of this invention is designed for use with a specially constructed rivet 25, of a general known construction type which is commercially available. However, in accordance with the present invention, applicants have found that the rivet must be modified from its conventionally available commercial design to specific tolerances as described hereinafter.

Figure 3:
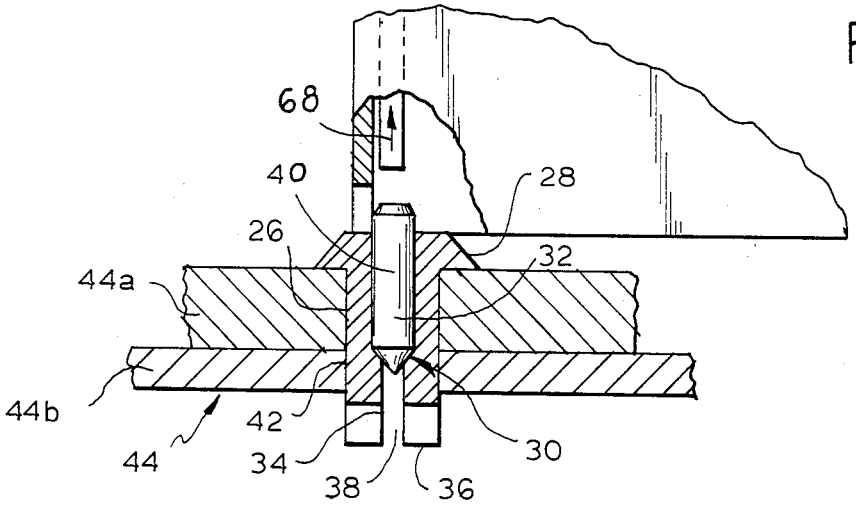
FIG. 3 is a side sectional view of the staple gun shown in FIG. 1 engaged with a rivet in position prior to operation of the tacker.

The rivet, as seen in FIG. 3, includes an outer rivet member having a shank 26 and a head 28. The shank and head have an internal bore 30 which includes an upper bore section 32 of larger diameter than the lower bore section 34. The lower, piercing, or penetrating end 36 of the rivet has one or more diametric slots 38 formed therein to facilitate the spreading of the piercing end of the rivet upon operation of the staple gun. It is to be understood that while end 36 is referred to as a piercing end, because it passes through the workpiece, it performs no cutting action but is placed in a predrilled hole in the workpiece before the staple gun tacker is operated to spread it.

The rivet includes a drive pin 40 frictionally engaged in the upper bore portion 32 of the rivet shank. The diameter of pin 40 is approximately the same as the diameter of the upper section 32 of the bore, but larger than the lower section 34 of the rivet bore. When the staple gun tacker is operated as described hereinafter, pin 40 is driven into the rivet (which had been previously manually placed in the predrilled bore 42 in workpiece 44) thereby forcing the pin 40 into the lower bore section, spreading out the piercing end of the rivet.

Applicants have found that the dimensions of the rivet design are important to the operation of the staple gun tacker for the purpose of driving the rivets. While rivets of the general type of construction just described have been available for installation with other tools, or even with a hammer, it has been found that the staple gun tacker will operate most successfully if pin 40 has an external diameter of about 0.077 inches. This pin also has knurls on its outer surface to retain the pin in the rivet during storage and transportation prior to use. These knurls preferably have a diameter of about 0.080 inches. The diameter of the bore section 32 in the rivet is about 0.080 inches. With these dimensions for the rivet, applicants have found that the staple gun tacker will provide sufficient power to drive pin 40 to operate the rivet satisfactorily in a wide variety of applications. With greater tolerances, the pin may not be driven satisfactorily, and with lesser tolerances the pin may be driven through the rivet entirely without providing a positive metal interference on the bottom of the piercing end thereof.

In the illustrative embodiment shown in FIG. 3, workpiece 44 consists of two elements 44*a* and 44*b* to be joined together by the rivet. These elements have a hole 42 drilled therein which receives the rivet before pin 40 is driven. Of course, it is to be understood that the length of the shank portion of the rivet may be varied as desired, depending upon the thickness of the workpieces to be joined.

Referring again to FIG. 1 of the drawing, the cover 24 of the staple gun of the invention includes lower free end 48 and a front face 50 which overlies and covers the working end 20 of the staple gun tacker 10 and in particular drive blade 68, to which it is closely adjacent. The lower free end 48 of the cover has a generally rectangular opening or recess 50 formed therein which has width and height dimensions of about three-eighths of an inch. Upon operation of the staple gun to drive the rivet pin, the handle 12 is squeezed to raise the blade 68 slightly. With the blade raised, the opening 50 can be aligned with the pin 40 so that the pin enters the staple gun behind cover 24 below blade 68, as seen in FIG. 3. Thus, the recess or opening 50 serves to align the rivet pin 40 with the drive blade 68 of the staple gun within the gun itself. Then, when handle 12 is squeezed further, to "fire" the staple gun and apply a driving force to blade 68, the rivet will be properly set.

Figure 2:
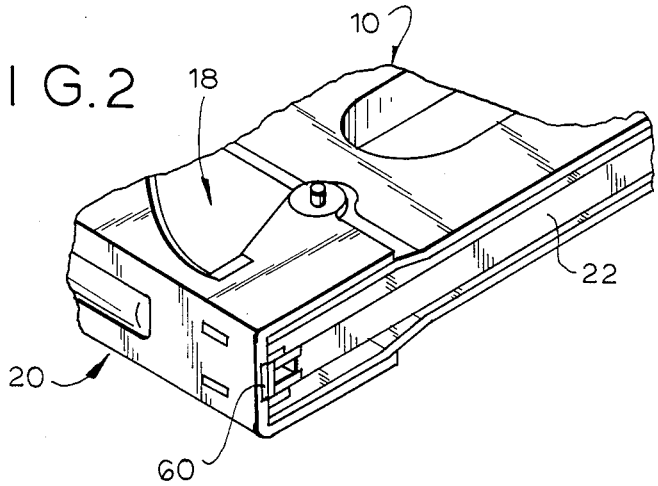
FIG. 2 is a partial perspective view similar to FIG. 1 showing another embodiment of the present invention.
Figure 4:
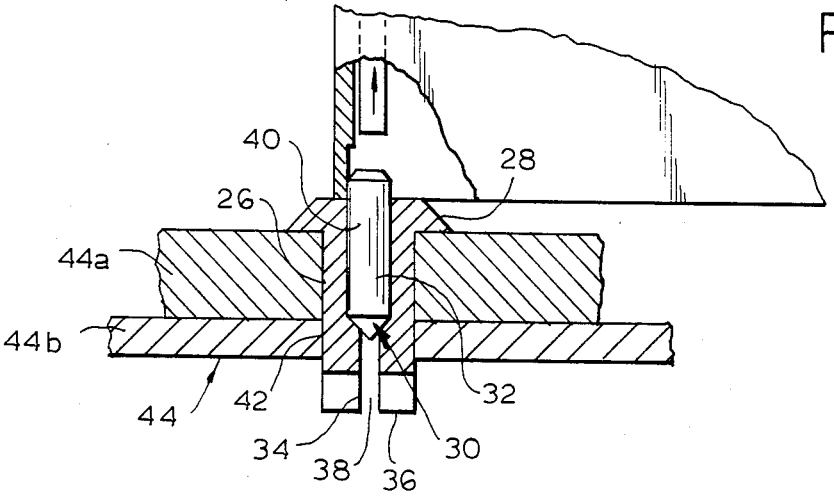
FIG. 4 is a side sectional view similar to FIG. 3 but showing the embodiment of FIG. 2.

In the embodiment of the invention illustrated in FIG. 2, cover 24 has a recess 60 formed in its front face 48 in lieu of the notch 50 which defines a groove or recess facing the drive blade 68. This recess has a width dimension of about $\frac{3}{8}''$, similar to that of notch 50, and a depth y of about 0.015. As seen in FIG. 4, with this construction, when the staple gun is placed downwardly over a rivet 24 which has previously been placed in a workpiece and handle 12 is squeezed to raise blade 68 the recess locates the blade of the staple gun about the rivet and in alignment with the pin 40.

By this construction of the front cover of the staple gun tacker, according to either embodiment of the present invention, it is relatively easy for the operator to align the drive pin 40 of the rivet and the drive blade 68 of the staple gun by simply seating the recess 60 or notch 50 in the front cover on the pin member of the rivet when partly depressing the handle. With the rivet's pin member located within the front cover of the staple gun in this manner, the staple gun tacker can be operated in the conventional manner to drive blade 68 downwardly to engage pin 40.

More particularly, to drive pin 40 once it is aligned with blade 68 by the recess or notch of the cover, handle 12 of the staple gun tacker is squeezed further, in the conventional manner, to "fire" the gun. As is known, in the operation of the staple gun tacker in this manner, drive blade 68 is further raised from the positions shown in FIGS. 3 and 4 by the operating mechanism (not shown) relative to the bottom 98 of the staple gun tacker. In the operation of the staple gun tacker as a stapler, the raising of the drive blade permits the magazine to move a staple into position beneath the blade. In operation of the device to set rivets, no staples are present in the magazine, or the magazine itself is removed. In either event, there are no staples present to interfere with operation of the staple gun to set the rivets. When the handle is completely squeezed, the blade 68 is raised above the positions of FIGS. 3 and 4 and once the handle is squeezed beyond a predetermined point, the operating mechanism of the staple gun tacker fires, to drive blade 68 downwardly with a predetermined force in a known manner from the raised position back to the lowermost position of the blade, shown in FIG. 5.

Figure 5:
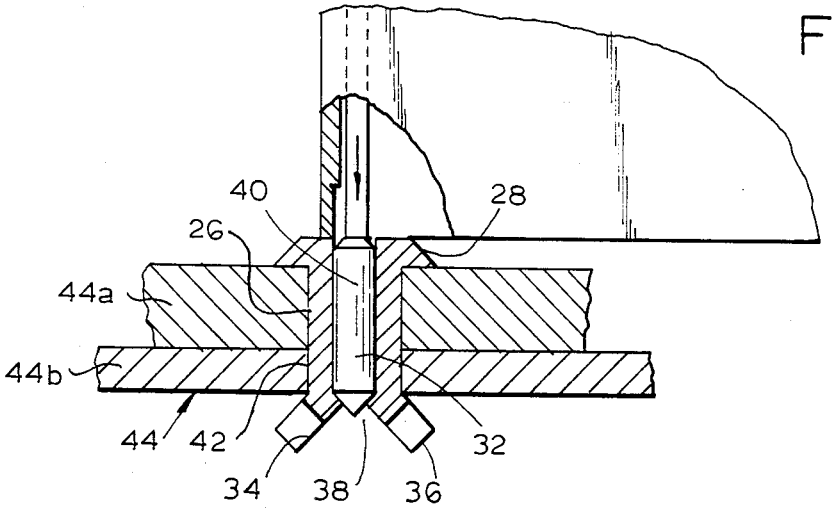
FIG. 5 is a side sectional view similar to FIG. 3 showing the configuration of the device and the operation thereof after firing of the driving blade of the staple gun tacker.

This downward movement of blade 68 imparts a substantial amount of energy to rivet drive pin 40 to force this pin down through the bore of the rivet into the lower bore section thereof. This force causes the lower end of the rivet to spread apart, as illustrated in FIG. 5, thus forming a secure attachment between the workpiece elements 44*a* and 44*b*.

By this construction of the invention, a relatively simple construction for a staple gun tacker is provided which enables an otherwise conventional hand or electric, pneumatic, other type staple gun tacker to be used for an additional purpose, namely the installation of rivets. Thus, the homeowner can install rivets in workpieces without the need for buying an additional complete special purpose tool or an attachment. All that the homeowner requires now is the single staple gun tacker to provide both functions.

Although the present invention has been described with reference to the illustrative embodiments of the invention, it is to be understood that various changes and modifications may be effected therein by those skilled in the art without departing from the scope or spirit of this invention.

What is claimed is:

1. In a staple gun tacker having a staple driving mechanism including a staple driving blade contained within a housing having a relatively flat elongated bottom side, the improvement comprising a front cover for said housing for permitting installing or setting a rivet of the type having a pin member mounted in a rivet shank having an expandable workpiece piercing free end, said front cover including a front wall located on the working end of the staple gun tacker parallel to and adjacent said driving blade, said front wall having a lower edge portion aligned with and lying in substantially the same plane as said bottom side of the housing and also having a rear face located adjacent and parallel to the driving blade of the staple gun tacker, said rear face having a groove formed therein extending in the direction of sliding movement of the driving blade to a lower end located and opening at the lower edge portion of said front wall thereby defining a recess in the rear face of said front wall in parallel alignment with the driving blade of the staple gun tacker for receiving a portion of the pin member of the rivet and aligning it with said driving blade such that the pin member is impacted by the driving blade when the staple gun tacker is operated to apply a driving force thereto which drives the pin member of the rivet to expand the free end of the rivet.

2. The combination of a rivet having a pin member mounted in a rivet shank which has an expandable workpiece piercing free end and a staple gun free end, and a staple gun tacker having a staple driving blade contained within a housing having a relatively flat, elongated bottom side, and a front cover for the housing for permitting installing or setting of the rivet, said front cover including a front wall located on the working end of the staple gun tacker parallel to and adjacent said driving blade thereof, said front wall having a lower edge portion aligned with and lying in substantially the same plane as said bottom side of the housing and a generally rectangular notch cut out of said front wall and having an opened bottom edge at the lower edge of said front wall, said notch lying in the plane of said front wall in parallel alignment with the driving blade of the staple gun tacker for receiving the pin member of the rivet through said front wall and aligning the pin member with said driving blade, such that the pin member is impacted by the driving blade when the staple gun tacker is operated to apply a driving force thereto which drives the pin member of the rivet to expand the free end of the rivet.

3. The combination as defined in claim 2 wherein said notch's opened bottom edge has a linear width dimension of about $\frac{3}{8}''$.

4. The combination of a rivet having a pin member mounted in a rivet shank which has an expandable workpiece piercing free end, and a staple gun tacker having a staple driving mechanism including a staple driving blade contained within a housing having a relatively flat elongated bottom side, and a front cover for said housing for permitting installing or setting of the rivet, said front cover including a front wall located on the working end of the staple gun tacker parallel to and adjacent said driving blade, said front wall having a lower edge portion aligned with and lying in substantially the same plane as said bottom side of the housing and also having a rear face located adjacent and parallel to the driving blade of the staple gun tacker, said rear face having a groove formed therein extending in the direction of sliding movement of the driving blade to a lower end located and opening at the lower edge portion of said front wall thereby defining a recess in the rear face of said front wall in parallel alignment with the driving blade of the staple gun tacker for receiving a portion of the pin member of the rivet and aligning it with said driving blade such that the pin member is impacted by the driving blade when the staple gun tacker is operated to apply a driving force thereto which drives the pin member of the rivet to expand the free end of the rivet.

* * * * *